US007252533B1

(12) United States Patent
Lee

(10) Patent No.: US 7,252,533 B1
(45) Date of Patent: Aug. 7, 2007

(54) QUICK-DISCONNECT COUPLING SYSTEM WITH EMERGENCY RELEASE FEATURE

(75) Inventor: William H. Lee, Petaluma, CA (US)

(73) Assignee: Interlemo Holding SA, St. Sulpice (CH)

( * ) Notice: Subject to any disclaimer, the term of this patent is extended or adjusted under 35 U.S.C. 154(b) by 0 days.

(21) Appl. No.: 11/551,693

(22) Filed: Oct. 20, 2006

Related U.S. Application Data

(60) Provisional application No. 60/740,739, filed on Nov. 29, 2005, provisional application No. 60/728,859, filed on Oct. 20, 2005.

(51) Int. Cl.
*H01R 4/38* (2006.01)
*H01R 13/648* (2006.01)

(52) U.S. Cl. ..... 439/382; 439/63; 439/675

(58) Field of Classification Search ..... 439/63, 439/382, 474, 607, 675, 923
See application file for complete search history.

(56) References Cited

U.S. PATENT DOCUMENTS 4,909,761 A * 3/1990 Muguira ..... 439/620.29
5,021,002 A * 6/1991 Noschese ..... 439/352
5,346,406 A * 9/1994 Hoffman et al. ..... 439/474
5,427,542 A * 6/1995 Gerow ..... 439/314
5,890,930 A * 4/1999 Gerow ..... 439/651
5,993,246 A * 11/1999 Moldenhauer et al. ..... 439/474
6,146,188 A * 11/2000 Snyder ..... 439/475
6,511,341 B1 * 1/2003 Finona et al. ..... 439/475

* cited by examiner

*Primary Examiner*—James R. Harvey
(74) *Attorney, Agent, or Firm*—Craig M. Stainbrook; Stainbrook & Stainbrook, LLP

(57) ABSTRACT

A quick-disconnect coupling device for use in plug and receptacle style electrical connectors, fiberoptic connectors, pneumatic and hydraulic couplings or any other application where a secure quick-disconnect connection is desired. Under normal operation, the coupling device incorporates a sliding outer sleeve to activate and release latching features within the retention system, which engages with an appropriate mating receptacle. An emergency release feature is included to allow the coupling to disconnect at a selectable, predetermined axial pull-force on the rear of the coupler. The secondary release feature prevents damage to the components and, in many applications, increases personal safety, by providing an emergency release feature, while still maintaining standard coupling and decoupling functionality.

1 Claim, 8 Drawing Sheets

QUICK-DISCONNECT COUPLING SYSTEM WITH EMERGENCY RELEASE FEATURE

CROSS REFERENCES TO RELATED APPLICATIONS

The present application claims the benefit of U.S. Provisional Patent Application Ser. No. 60/728,859, filed Oct. 20, 2005, (Oct. 20, 2005), and U.S. Provisional Patent Application Ser. No. 60/740,739, filed Nov. 29, 2005 (Nov. 29, 2005).

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

The present invention relates generally to coupling devices, and more particularly to a quick-disconnect coupling device for use in applications such as plug and receptacle style electrical connectors, fiberoptic connectors, pneumatic and hydraulic couplings or any other application where a secure quick-disconnect connection is desired.

2. Discussion of Related Art Including Information Disclosed Under 37 CFR §§ 1.97, 1.98

Quick-disconnect coupling devices are often used in applications requiring frequent coupling and decoupling, yet requiring a secure engagement due to the application environment having a probability of inadvertent forces being applied to the device being coupled. This can occur, for example, with a person tripping over a cord or hose, cabling catching on clothing, hoses or cables tangling with moving equipment, equipment being moved without first disconnecting the coupling and other similar situations and occurrences. Inadvertent disconnection is a concern in many applications where interruption of function would create hazardous conditions or have otherwise undesirable results or effects. For these reasons, there are many coupling devices that have secure latching systems to prevent such an inadvertent or accidental disconnect.

In some applications, another desire is an emergency release feature. This is a requirement in many stationary and mobile applications where personnel safety and equipment survival cannot be compromised. Some specific examples where personal injury could occur due to a non-releasing connection are helmet-to-equipment connections such as those found on police and civilian motorbikes for radio connections and for aircraft pilots that may need to hastily exit or eject from an aircraft. Worn-equipment configurations, often for communications or computer connections, exist within many applications including law enforcement, military infantry and special operations units, firefighting and other professions where interference with critical duties could be caused cables, hoses, tubes and the like, snagging or entangling with other objects. Examples of applications where equipment damage could occur include railroad railcar connections, towed vehicle connections and a multitude of others. These applications require the original secure coupling system plus an emergency release feature that will allow the coupling to disconnect at a selectable, predetermined force. In many applications it is important that the emergency release feature is a repeatable, consistent function and does not significantly degrade in release force for a large number of disconnect cycles over the lifetime of the installed equipment.

There have been numerous efforts to address these problems. A small sample of exemplary devices are shown in the following documents.

U.S. Pat. No. 5,021,002, to Noschese, shows a snap-lock electrical connector having an automatic disconnection feature. The electrical connector has a housing, a plurality of contacts, a snap-lock latch and a movable outer hood. The snap-lock latch can automatically mechanically connect and retain the housing to a second connector. The movable outer hood can be pulled by a user after connection which disconnects the latch and results in the disconnection of the electrical connector from the second connector.

U.S. Pat. No. 5,346,406, to Hoffman, et al., discloses an electrical cable and connector assembly having an electrical cable with power conductors and a pilot conductor releasably coupled to an electrical contact in an electrical connector, so that the pilot conductor releases from the electrical contact of the connector when a mechanical stress or force is applied to the cable. The power conductors are spirally wrapped about the centrally located pilot conductor so that the power conductors can stretch while the pilot conductor is pulled from its electrical contact upon application of the force or stress on the cable.

U.S. Pat. No. 6,146,188, to Snyder, teaches a shear connector includes a plug connector having front and rear insert portions on opposite sides of the shear plane that are held together by a shear bolt scored to shear at a predetermined force, and which is threaded directly into openings in the rear insert in such a way as to eliminate relative movement between the shear bolts and the rear insert during shearing. Pin contact sections extending rearwardly from the front insert are scored at the shear plane to shear at a predetermined force. By varying clearances between the pin contact sections and the sides of the openings of the rear insert into which the pin contact sections extend, groups of contacts can be made to shear at different times, thereby reducing the force required to shear each group without unduly weakening the contacts.

U.S. Pat. No. 6,511,341, to Finona, et al., shows a break-away apparatus for electrical and optical connectors having front and rear fittings with peripheries that have pairs of aligned fastener-receiving holes, and a plurality of fasteners that each lies in a pair of holes and holds the peripheries of the fittings together. Each fastener is a screw with a shank having a threaded front end that engages threads in the hole of the front fitting, and includes a screw head at the rear of the shank which lies against a rearwardly-facing shoulder on the rear fitting to prevent fitting separation. A bore extends along the axis of the shank, and a rear end portion of the shank has a groove, creating a break-away portion of the fastener that has a ring-shaped cross-section. The ring-shaped coss-section permits tightening of the screw but results in the screw breaking when a predetermined force is applied to allow separation of the fittings.

U.S. Pat. No. 427,542, to Gerow, discloses a connector that allows the connector main part to be pulled out of a coupling nut or part when the cable that extends rearwardly from the main part is pulled with a sufficiently large force. The main part is of the type that includes a metal shell enclosing an insulator that holds contacts whose front ends mate with the contacts of a mating connector device and whose rear ends connect to wires of the cable. The outside of the shell and the inside of the coupling part have adjacent grooves, and an expandable ring-shaped retainer lies in both grooves to normally hold the main part to the coupling part. The forward wall of the groove in the main part is inclined from an axial direction to form a ramp. If the main part is pulled rearwardly with a large force, the retainer expands as it rides up the ramp and past the front of the main part, to thereby release the main part from the coupling part and the connector device to which it is coupled.

U.S. Pat. No. 5,993,246, to Moldenhauer, et al., teaches a coupler for connecting a first element to a second element, including a first connector piece securable to the first element; a second connector piece for attaching to the first connector piece; and a flexible breakaway device mounted on the second element for releasably securing the second connector piece to the second element. A method of connecting and disconnecting a first element and a second element includes the steps of providing a first connector piece on the first element; attaching a breakaway device to the second element; attaching a second connector piece to the breakaway device that is attached to the second element; securing the first connector to the second connector; releasing the second connector piece from the second element by deflecting a portion of the breakaway device when a separation force is applied between the first and second elements.

U.S. Pat. No. 4,909,761, to Muguira, discloses an electric fuse holder having a cylindrical receiving body with an internally threaded nut attached in a manner that allows relative rotation between them. The assembly of the nut to the body allows separation of the nut from the body when a predetermined axial separating force is imparted between the parts, without damage to them. A second fuse receiving body has an external thread which engages the thread of the first body. As the threaded connection is made the body sections are drawn together to enclose the fuse.

FIGS. 1A and 1B schematically depicts an example of one of the many styles of the typical and well known quick-disconnect coupling systems. FIG. 1A shows the coupling system before disconnection, and FIG. 1B shows the coupling system during the disconnect action. The coupler consists of an inner latching sleeve 120 with cantilever beam latch-tabs 180, which are retracted by the sliding outer shell release sleeve 140 of the coupler plug. As the outer shell sleeve 140 is pulled axially with a force in direction F, the angled surface 185 of the latch tabs 180 causes them to retract toward the axis or center of the plug 195, withdrawing from the latch retaining groove 175 in the receptacle shell 170. As the operator continues to pull the outer shell 140, the latch tabs 180 bend as fully as necessary to drive the angled surface of the latch-tab interiorly and fully out of the retaining groove and the plug may be extracted from the receptacle 170 with relatively little resistance. Similar sliding release sleeve concepts are used with other locking schemes such as the ball detent and angled wedge type systems.

Still referring to FIGS. 1A and 1B, and stated summarily, existing coupling systems are designed to latch securely and prevent accidental disconnect due to pull on the cable 160 or any other object that is secured to the rear 110 of the coupler, or a pull applied directly to the rear of the coupler. The established approach to creating an emergency release feature is to reduce the retention force. This primary latching system is then subjected to forces and excessive abusive disconnects (such as cable pulls) that it was not intended to accommodate. This typically means variation and degradation of the retention force over time. Another very common approach is to raise the normal disconnect force of the primary latching system. One disadvantage of this is that the "normal" (intentional) disconnect force is higher than desired. Also, the higher forces employed can accelerate wear and variation over time.

The foregoing patents and typical prior art device reflect the current state of the art of which the present inventor is aware. Reference to, and discussion of, these patents and the illustrated device is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

BRIEF SUMMARY OF THE INVENTION

The present invention answers the above-indicated needs by providing a quick-disconnect coupler having an emergency release feature that includes standard locking systems for normal use along with a higher force emergency release feature. The invention is a two-stage release mechanism. It preserves the desirable, (relatively low) force requirement for normal (intentional) disconnection while providing a higher, selectable and repeatable force to facilitate disconnection (emergency release) upon a predetermined pull-force on the rear of the coupler (which is typically secured to a cable, hose, conduit, etc., or sometimes directly to a piece of the system hardware).

It is therefore an object of the present invention to provide a new and improved quick-disconnect coupling system with an emergency release feature that can be used with all latching systems where an axial pull release locking coupling system is employed.

Another object of the present invention is to provide a quick-disconnect coupling device for use in wide variety of applications, including plug and receptacle style electrical connectors, fiberoptic connectors, pneumatic and hydraulic couplings or any other application where a secure quick-disconnect connection is desired.

Still another object of the present invention is to provide a quick-disconnect coupling system with an emergency/breakaway release feature which effects disconnection at a predetermined axial pull-force on the rear of the coupler or cables held by the connection Yet another object of the present invention is to provide a quick-disconnect coupling system wherein a secondary release feature prevents damage to the components while providing standard coupling and decoupling functionality.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty that characterize the invention are pointed out with particularity in the claims annexed to and forming part of this disclosure. The invention does not reside in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein:

FIG. 2A1 is an enlarged detail taken along the dotted ellipse 2A1 of FIG. 2A;

FIG. 2B-1 is an enlarged detail view taken along the dotted ellipse 2B1 of FIG. 2B;

FIG. 2C-1 is an enlarged detail view taken along the dotted ellipse 2C1 of FIG. 2C;

FIG. 3A-1 is an enlarged detail view taken along the dotted ellipse of FIG. 3A;

FIG. 3B1 is an enlarged detail view taken along the dotted ellipse of FIG. 3B;

FIG. 4A-1 is an enlarged detail view taken along the dotted ellipse of FIG. 4A;

FIG. 4B-1 is an enlarged detail view taken along the dotted ellipse of FIG. 4B.

DRAWING REFERENCE NUMERAL LEGEND

Figure 1A:
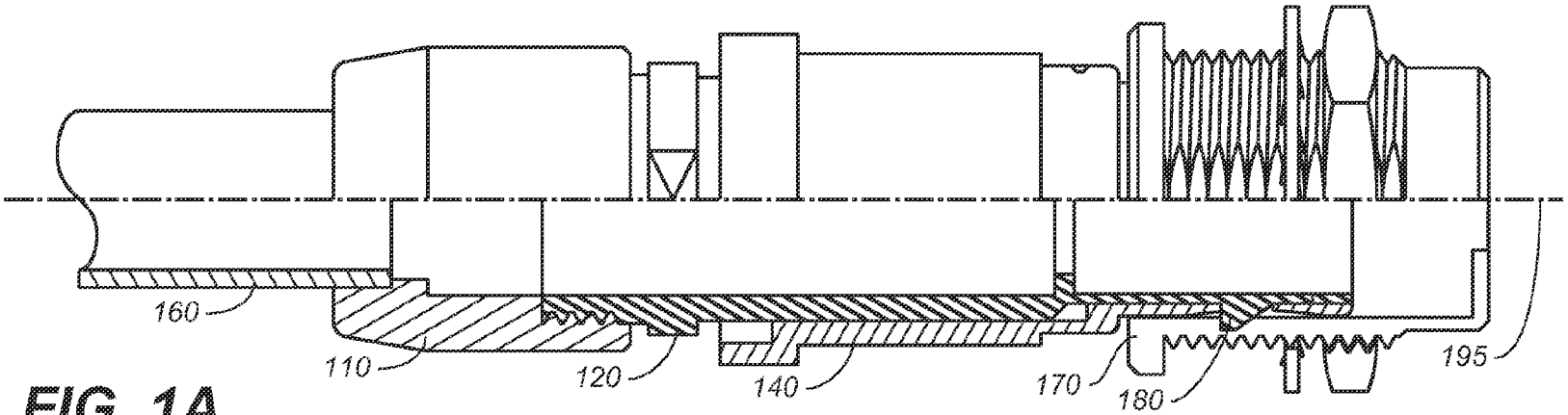
FIG. 1A (PRIOR ART)
FIGS. 1A and 1B are partial cross-sectional side views showing a typical prior art quick-disconnect coupling device before and during a disconnect action (discussed in detail in the Background Discussion of Related Art, above)
Figure 1B:
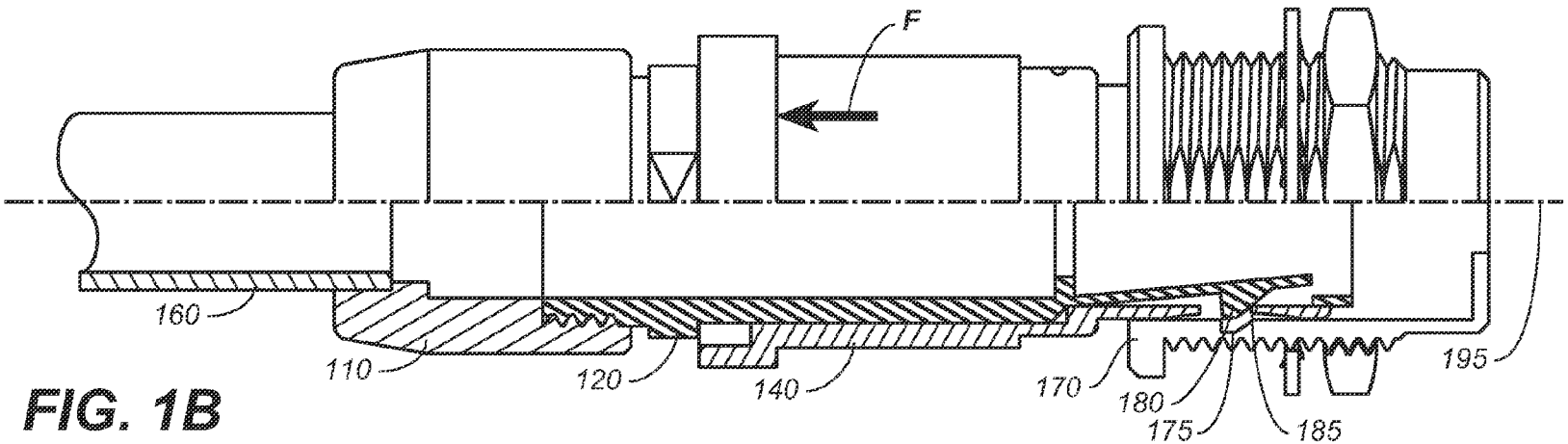
FIG. 1B (PRIOR ART)

FIGS. 2A-2*c*-1
200 first preferred embodiment of inventive connector
202 proximal shell
204 latch arm sleeve
206 medial coupler
208 distal clamp member
210 coupler ring
215 interior ring (of medial coupler)
216 stop (in proximal shell)
217 proximal ring
220 latch arms
222 concentric bend (in latch arm sleeve)
224 neck portion (of proximal shell)
225 holes in neck portion
226 proximal edges of holes
227 distal collar (of latch arm sleeve)
228 outer surface of proximal shell
230 resilient member
245 collar (distal portion of proximal shell)
260 cable
280 ramps/angled portions (of the latch arms)
285 outer surface (face) of ramps
295 central axis of connector
FIGS. 3 through 3B-1
300 second preferred embodiment of present invention
302 proximal shell
304 latch arm sleeve
308 internal clamping member
309 proximal extension of internal clamping member
310 clamping element
320 latch arms
324 neck of proximal shell
330 resilient member
340 outer latch release sleeve
360 cable
370 receptacle
380 retaining groove
385 ramp face
395 axial center of connector
FIGS. 4A through 4B-1
400 third preferred embodiment of inventive connector
402 proximal shell
404 latching arm sleeve
408 internal clamping member
409 proximal extension (of internal clamping member)
410 clamping mechanism
412 second ramp structure
420 latching arms
424 neck portion of proximal shell
430 face of second ramp
432 corner of ramp face
440 release sleeve
470 receptacle
480 ramp portion of latching arms
485 ramp faces
487 tips of latching arms

DETAILED DESCRIPTION OF THE INVENTION

Referring now to FIGS. 2A through 4B-1, wherein like reference numerals refer to like components in the various views, there is illustrated therein a new and improved quick-connect coupling system having an emergency release feature, generally denominated 200 herein.

Figure 2A:
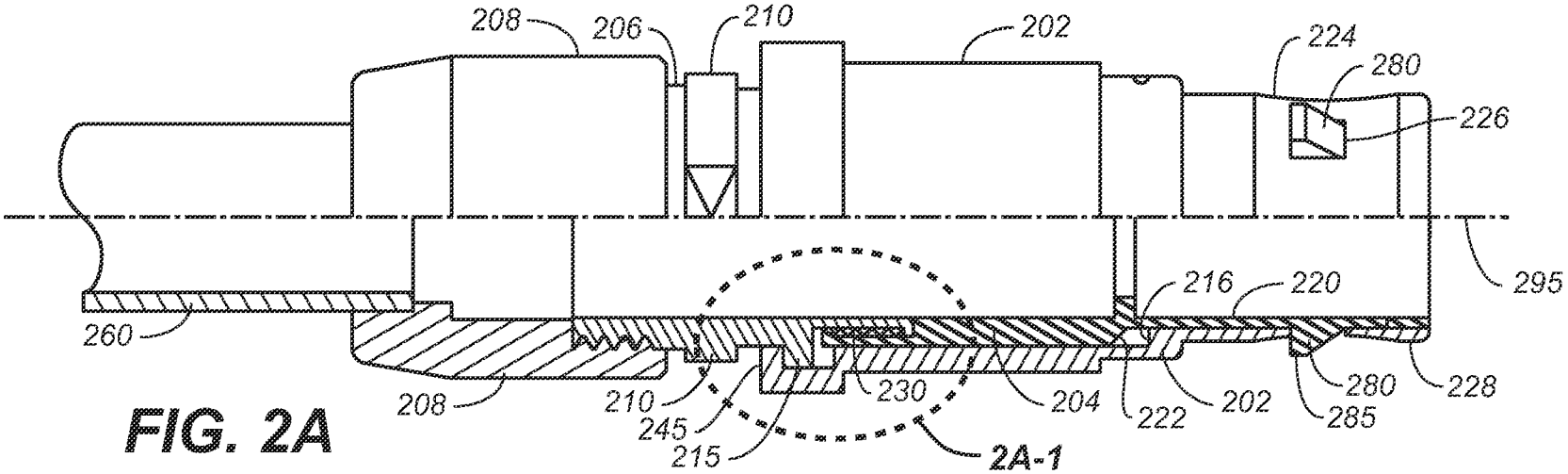
FIG. 2A is a partial cross-sectional side view in elevation of a first preferred embodiment of the inventive coupling system, showing the coupling apparatus before an emergency release feature has been activated.
Figure 2B:
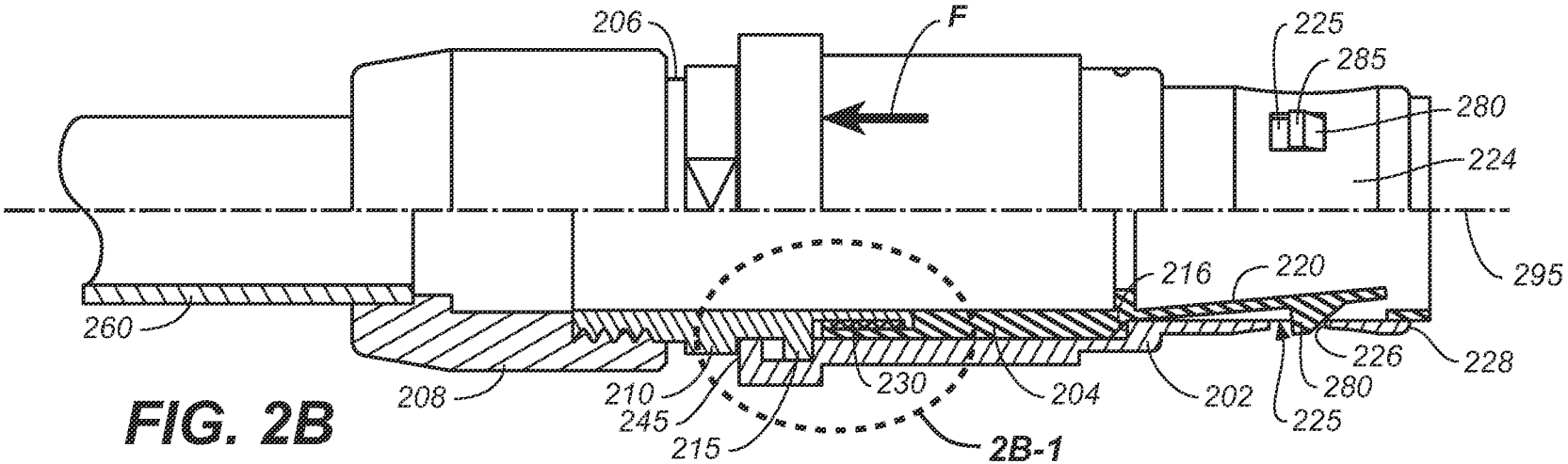
FIG. 2B is a partial cross-sectional side view in elevation showing the coupling system of FIG. 2A during a conventional disconnection.
Figure 2C:
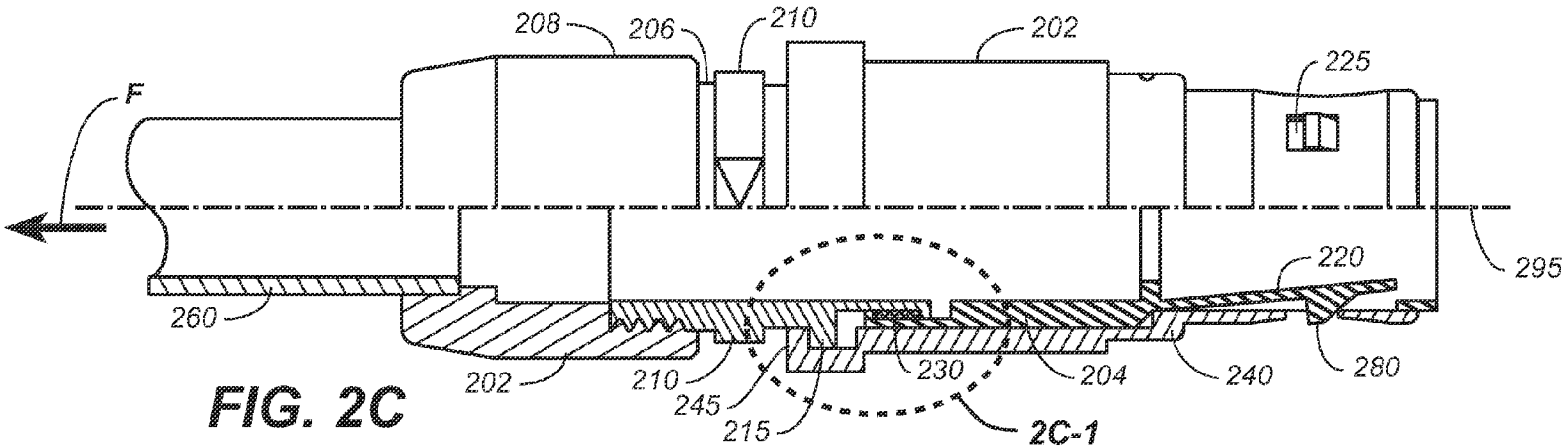
FIG. 2C is a partial cross-sectional side view in elevation showing the first preferred embodiment undergoing an emergency release.
Figures 1, 2A:
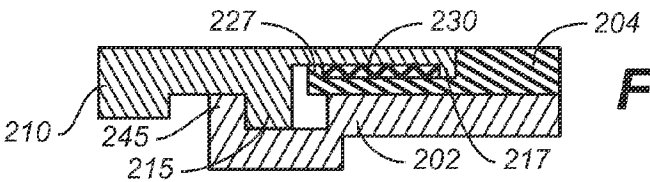
Figures 1, 2B:
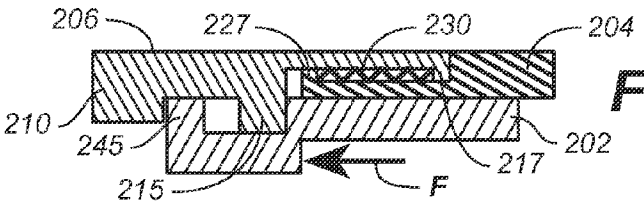
Figures 1, 2C:
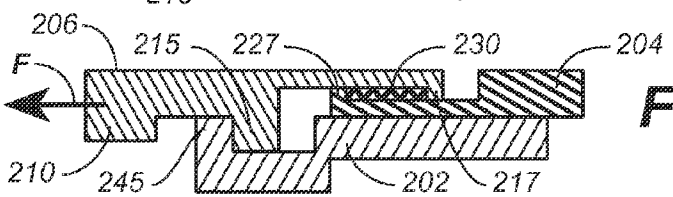

FIGS. 2A through 2C-1 show a first preferred embodiment of the present invention, with FIGS. 2A and 2A-1 showing the inventive coupling system 200 before disconnection, FIGS. 2B and 2B-1 during a conventional disconnection procedure, and FIGS. 2C and 2C-1 during an emergency release event.

The quick disconnect coupling system broadly comprises a proximal shell 202, a latch arm sleeve 204 slidably inserted into the proximal shell, a medial coupler 206 slidably inserted into the proximal shell, and a distal clamp member 208 threadably connected to the medial coupler.

The medial coupler 206 incorporates a clamping mechanism (detail not shown but well known in the art) to secure the coupler to a cable, hose, conduit or the like 260. The medial coupler and distal clamping member are operatively linked to the latch arms 220 of a latch arm sleeve 204 through a compressible resilient member 230, such as a helical compression spring, which is disposed between a proximal ring 217 of the medial coupler 206 and a distal collar 227 of the latch arm sleeve 204. It will be seen that a portion of the medial coupler is slidably inserted into latch arm sleeve 204 and that a portion of latch arm sleeve is slidably disposed between both the medial coupler 206 and the proximal shell 202. It will be further seen that the proximal shell includes a neck portion 224 having a plurality of square holes 225 through which ramps or angled portions 280 of the latch arms 220 are releasably inserted when the connector is not in a disengagement event, whether or not the connector is coupled to a receptacle.

Lateral translation of the slidably inserted latch arm sleeve 204 and latch arms 220 within the proximal shell 202 is limited by a concentric bend 222 which engages a stop 216 in the proximal shell.

Referring now to FIGS. 2B and 2B-1, when the distal clamp member remains relatively stationary, but the proximal shell 202 is translated laterally in the distal direction (left in the illustration), the proximal edges 226 of holes 225 of neck 224 engage the ramps or angled portions 280 of the latch arms 220 to drive them interiorly relative to the central axis 295 of the connector. The allowed amount of travel in such an event is sufficient to bring the outer surface 285 of the ramps into general alignment with the outer surface 228 of the proximal shell, so that the latch arms are released from a ledge engaged in a receptacle, and the connector can therefore be pulled out of disengagement.

It will be appreciated that lateral travel of the proximal shell is limited by an interior ring 215 of medial coupler 206 which comes into engagement with a collar 245 at the distal most portion of proximal shell 202. FIGS. 2B-1 shows clearly that in a conventional disconnection, proximal shell 202 moves relative to both lateral arm sleeve 204 and medial coupler 206, and when it has moved sufficiently far for the neck to drive the ramps inwardly, a release is effected.

Referring now to FIGS. 2C and 2C-1, in an emergency release event, an axial force is applied to urge lateral distal translation of the cable 260 and distal clamping member 208. When the medial coupler 206 is subjected to forces in direction F, it moves distally (away) from the latches 220. The properties of the resilient member 230 determine the force at which the rear of the coupler 206 moves relative to the proximal shell 202 and the latch arm sleeve 220. The cable and medial coupler will move relative to the proximal sleeve and latch arm sleeve until the resilient member is compressed between proximal collar 217 of medial coupler 206 and distal ring 227 of latch arm sleeve 202 until the compressive force exceeds a predetermined amount, at which time interior ring 215 of medial coupler 206 will come into engagement with a collar 245 of proximal shell 202 and begin translating proximal shell and proximal shell neck to drive the proximal edges 226 of the holes 225 against the latch arm ramps while the latch arms themselves are held by a receptacle edge. It is the retained engagement that holds the latch arms relative to the moving proximal shell until sufficient force has been applied to drive the latch arms inwardly for a complete breakaway disconnect.

Typical internal components for the inventive system are not shown to improve clarity in the illustration. In most instances, such components include, but are not limited to, electrical contacts or conductors, fiberoptic components, pneumatic tubes or hoses, fluidic or hydraulic components and any other components where connection utilizing a quick-disconnect coupling is desired. The internal subassemblies and components can be designed to move with the medial coupler during the emergency release function or they can designed to remain stationary with a service loop in the internal routing to allow relative movement of the coupling release components.

The resilient member 230 can be constructed in various configurations and materials such as a coil spring, wave washer, Belleville washer, cantilever spring, elastomer, or any other compliant member, provided the required performance properties are met. It is installed to create a telescopically (axially) oriented biasing force between the latch arm sleeve 204 and latch arms 220 and the medial coupler 206. The type of resilient device used, the release force needed, and the space requirements determine the specific location of the resilient member 230. Depending upon its specific location, the resilient member 230 may be designed to provide the desired force under conditions of either compression or tension as appropriate to its location within the system.

The desired breakaway force can be set by resilient member selection, by using multiple members in series or in parallel, by installing the member or members in a free state or with a preload, and by including adjustable preload settings using a variety of methods such as variable position components, shims and the like. A variety of indicators can be used if desired, to easily identify the selected breakaway force value. These include, but are not limited to the incorporation of, visual features, mechanical features, electronic identification techniques such as memory devices, radio frequency identifiers, and a host of other known techniques.

Figure 3:
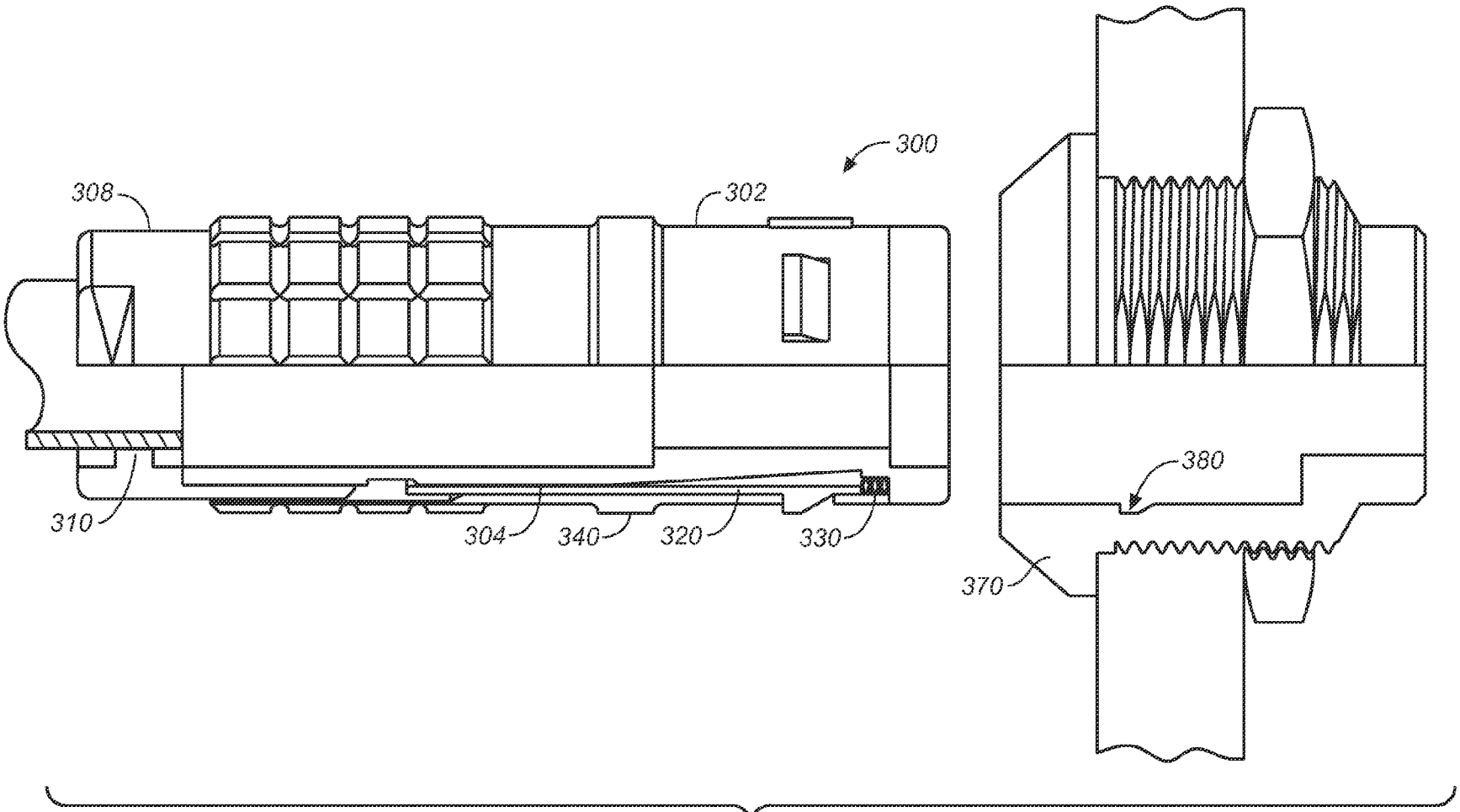
FIG. 3 is a partial cross-sectional side view in elevation of a second preferred embodiment of the present invention, showing the coupling system separate from the receptacle into which it will be mated upon connection.
Figure 3A:
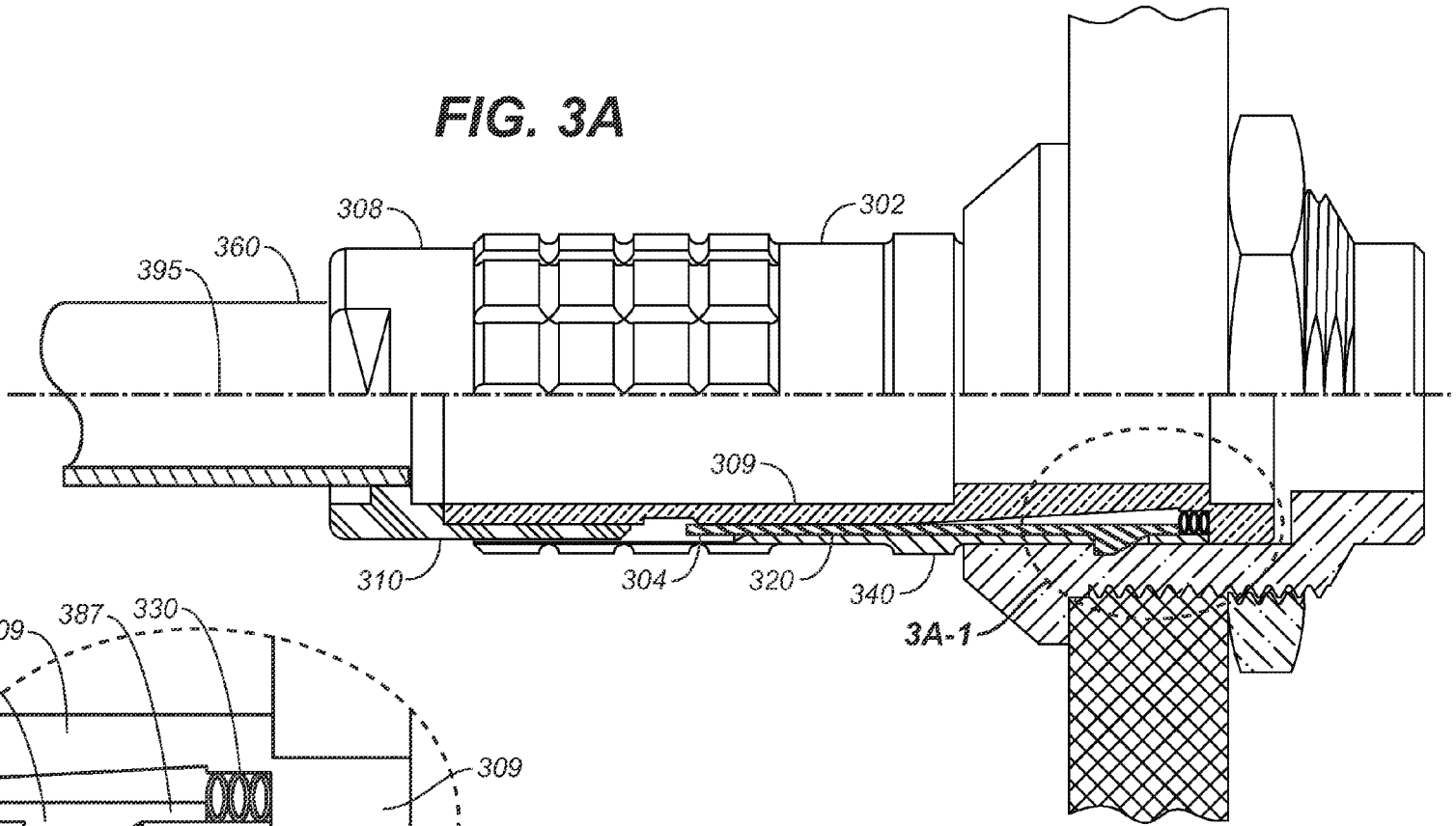
FIG. 3A is a partial cross-sectional side view in elevation of the second preferred embodiment showing the coupling system as mated and prior to an emergency release event.
Figures 1, 3A:
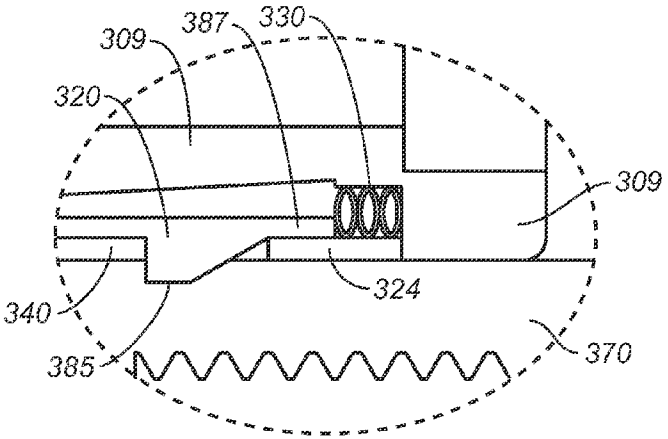
Figure 3B:
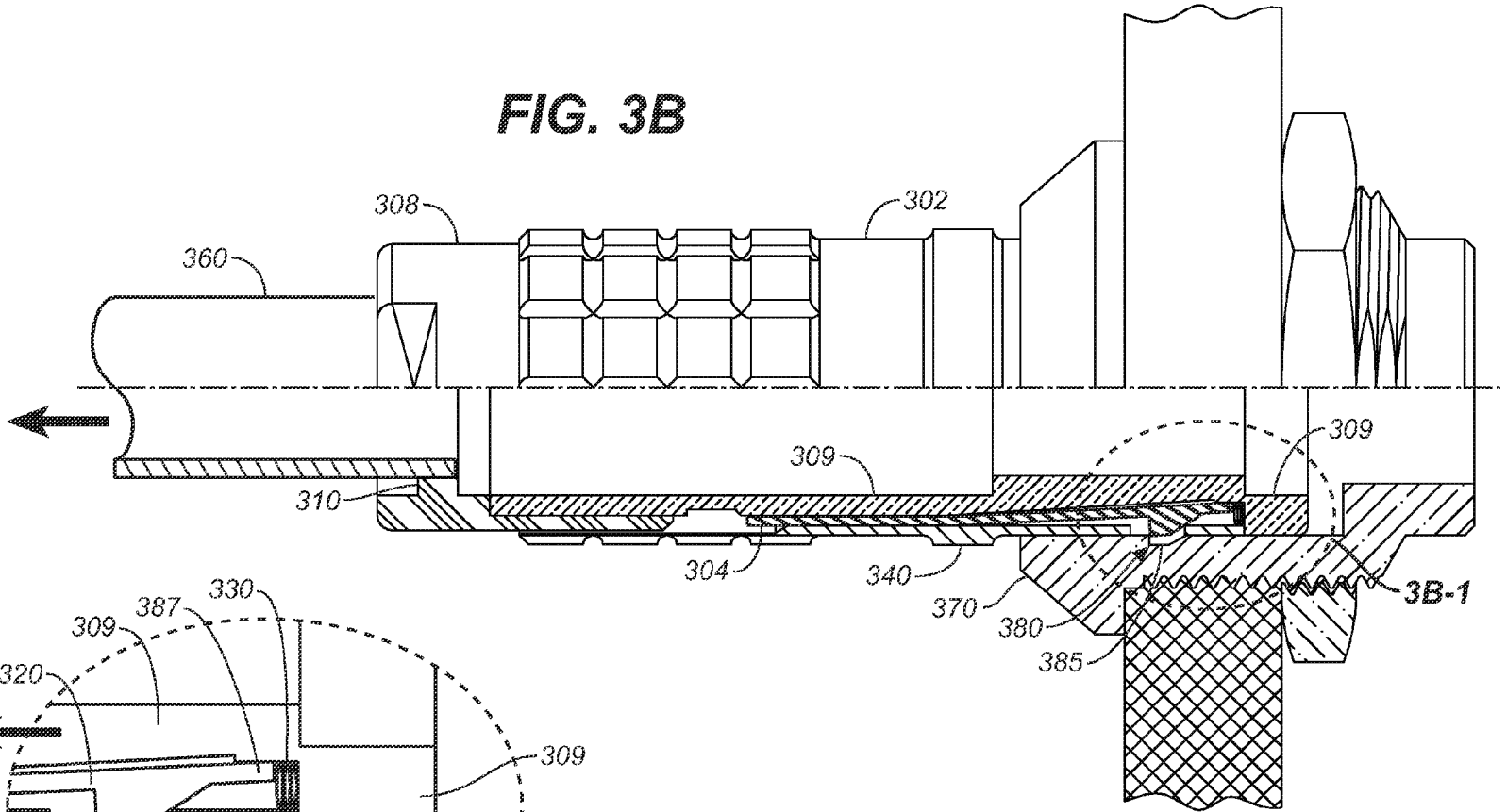
FIG. 3B is a partial cross-sectional side view in elevation showing the second preferred embodiment during an emergency release event.
Figures 1, 3B:
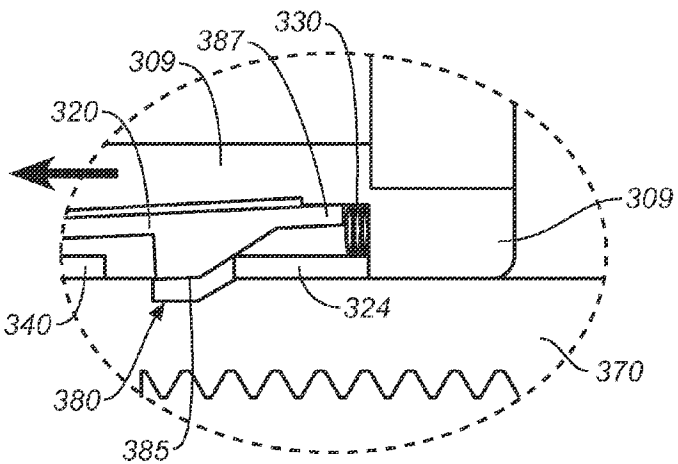

FIGS. 3 through 3B-1 show a second preferred embodiment 300 of the present invention, with FIGS. 3 through 3A-1 showing the coupling system as mated and prior to an emergency release feature activation, and FIGS. 3B and 3B-1 showing the system during an emergency release event.

Referring now to FIGS. 3 through 3A-1, in the second preferred embodiment, the connector comprises a proximal shell 302, a latch arm sleeve 304, and an internal clamping member 308 having a cable clamping element 310 at the distal portion. The locking latch arms 320 are mechanically loaded with force by a resilient member, where the force required to move the latch arms 320 corresponds to the desired breakaway force. The internal clamping member is functionally analogous to the medial coupler of the first preferred embodiment and contains the internal components and the clamping or mounting system 310. The clamping member is slidably inserted into the proximal shell and have movement restricted by structure at its proximal end, a resilient member 330 is disposed between the proximal end of the clamping member and the proximal end of the latch arm 320 and allows a predetermined axial movement of the latch arm sleeve 304 and latch arms 320 when force is applied. An outer latch release sleeve 340 preferably integral with the proximal shell) translates laterally (left in the illustration) to urge neck 324 against ramp 385 to actuate the latch release system during a normal disconnection. The only requirement of the resilient member 330 is that it apply a biasing force between the internal clamping member 308 and the latch arm sleeve 304. The resilient member 330 can be a feature incorporated into the latch arm sleeve 304 or the internal clamping member 308 or the resilient member 330 can be a separate part disposed between the latch arm sleeve 304 and the internal clamping member 308 or can be pre-assembled to one or the other. While the internal clamping member 308 and clamping system 310 can be separate components to facilitate assembly or provide other desired attributes, these two components could be combined into a single component without compromising the function of the system.

Referring next to FIGS. 3B through 3B-2, under the breakaway scheme of the second preferred embodiment, the rear of the internal clamping member 308 (which is typically secured to a cable, hose, conduit or the like 360) is pulled and translated axially until a predetermined force of the latch component resilient member 330 is overcome. The internal clamping member 308 and the release sleeve 340 translate laterally to the rear as indicated by the arrows. This causes the neck portion 324 of the release sleeve 340 to act upon the ramp or angled edge 385 of the latch arm 320 during its excursion. This action causes the latch arm 320 to depress interiorly into a shaped recess in a proximal extension 309 of the internal clamping member and toward the axial center 395 of the connector, and thereby to move out of engagement with the retaining groove 380 of the receptacle 370 resulting in the a release of the coupler from the receptacle.

It is not necessary that the release sleeve 340 be the component that acts upon the latch arms 320 to actuate movement of the latch arms. Any component placed into motion relative to the latch arms 320 as a result of the breakaway event can be used to apply the release force and motion resulting in an alternate embodiment of the same invention.

Under normal operation, the outer release sleeve 340 is translated laterally, and because it does not interact with the resilient member 330 under normal connect and disconnect functions, it allows the coupler to function the same as a standard push-pull type coupling system.

Once again, the resilient member 330 can be constructed in various configurations and fabricated from a variety of suitable materials. It may comprise a coil spring, wave washer, Belleville washer, cantilever spring, elastomer, or any other compliant member, provided the required performance properties are met. The resilient member 330 is installed to provide a telescopically (axially) oriented biasing force between the latch arm sleeve 304 and the proximal extension 309 of the internal clamping member 308. The type of resilient device used, the release force needed, and the space requirements determine the specific location of the resilient member 330. Depending upon its specific location, the resilient member 330 may be designed to provide the desired force under conditions of either compression or tension as appropriate to its location within the system.

The desired breakaway force can be set by resilient member selection, by using multiple members in series or in parallel, by installing the member or members in a free state or with a preload, and by including adjustable preload settings using a variety of methods such as variable position components, shims and the like. A variety of indicators can be used if desired, to easily identify the selected breakaway force value. These include, but are not limited to the incorporation of, visual features, mechanical features, electronic identification techniques such as memory devices, radio frequency identifiers, and a host of other known techniques.

Figure 4A:
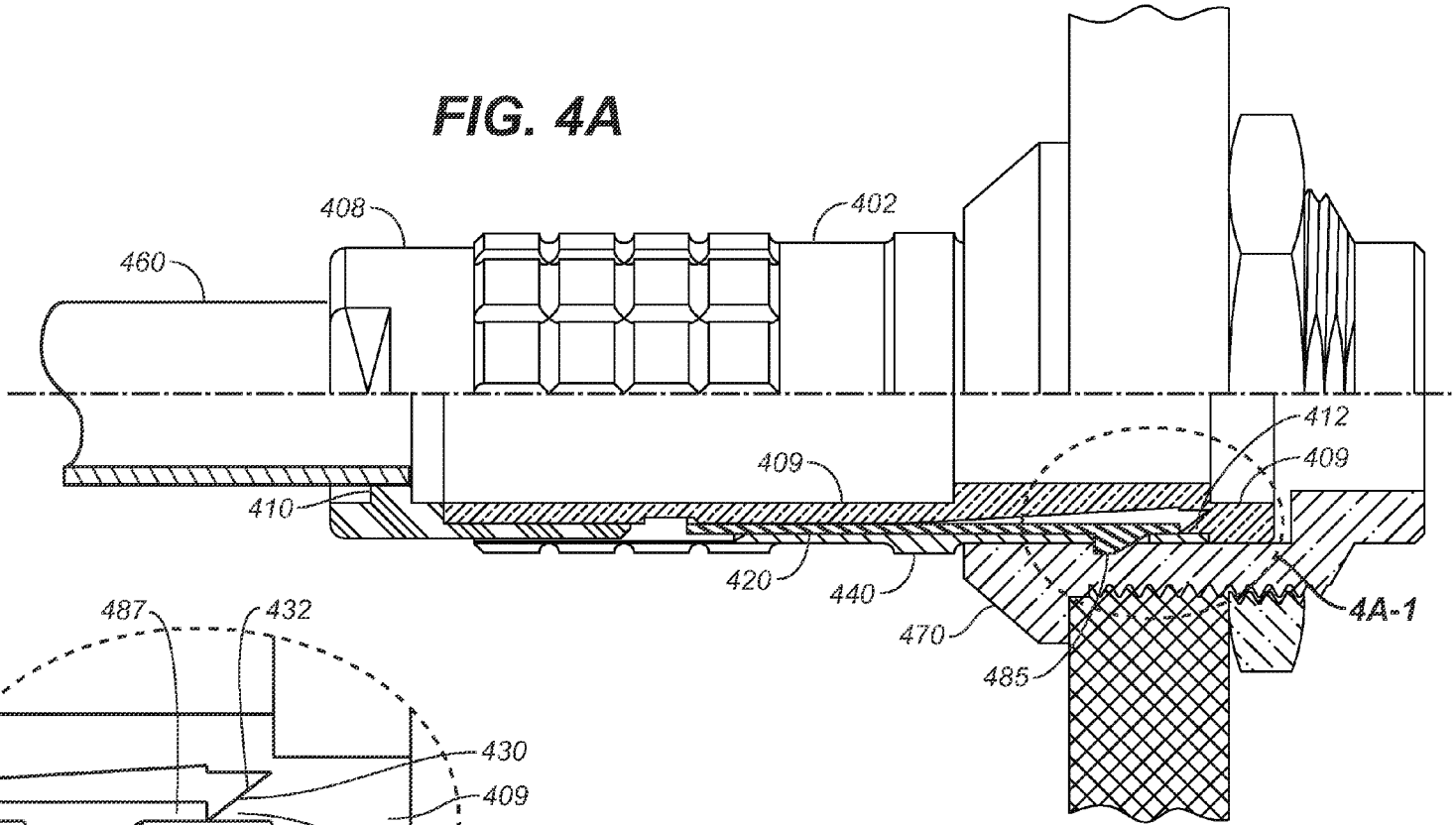
FIG. 4A is a partial cross-sectional side view in elevation showing a third preferred embodiment of the inventive system.
Figures 1, 4A:
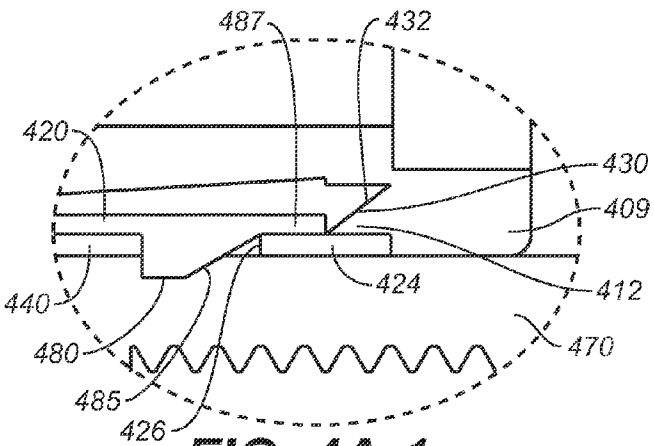
Figure 4B:
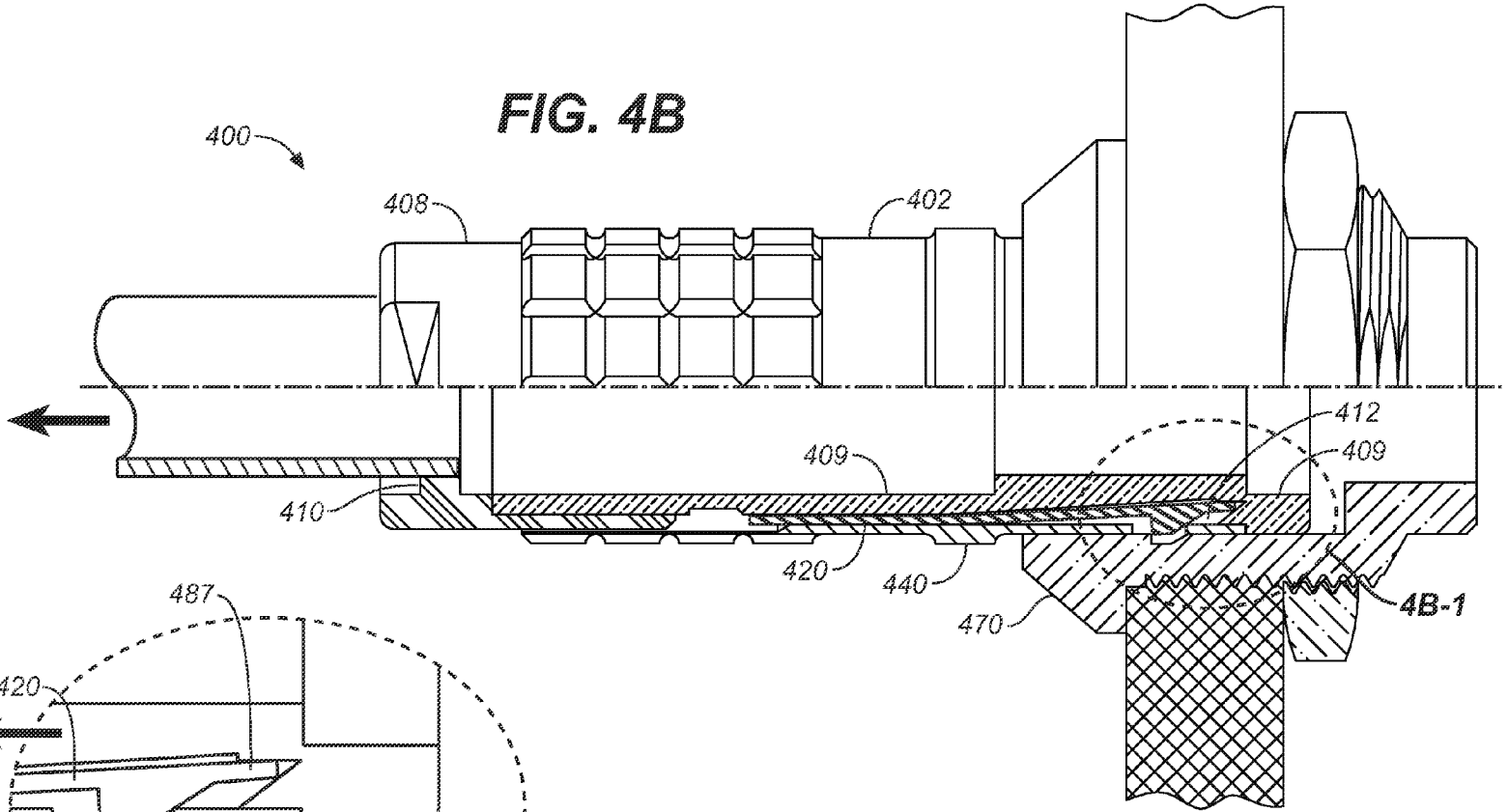
FIG. 4B is a partial cross-sectional side view in elevation showing the third preferred embodiment during an emergency release event.
Figures 1, 4B:
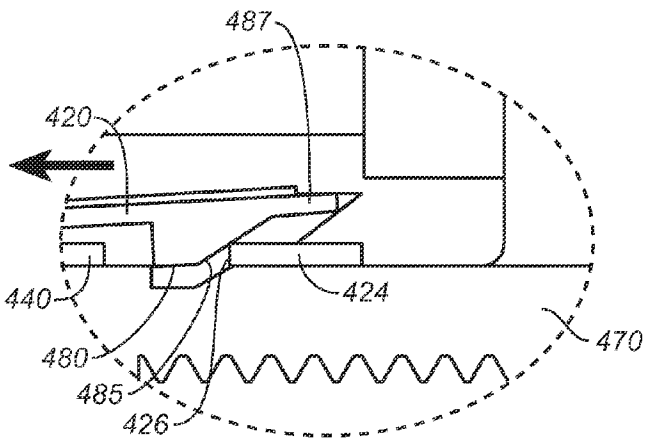

FIGS. 4A through 4B-1 show a third preferred embodiment 400 of the inventive quick-disconnect coupling system with emergency release feature of the present invention. In this embodiment, the structural elements are essentially identical to those of the second preferred embodiment, shown in FIGS. 3 through 3B-1. The apparatus includes proximal shell 402 slidably insertable into a connector receptacle 470. A latching arm sleeve 404 is slidably disposed within the proximal sleeve 402 and interposed between the internal clamping member 408, the proximal extension 409 of the internal clamping member, and the proximal sleeve. The internal clamping member 408 preferably includes a clamping mechanism 410 at its distal end. The latching arm sleeve 404 extends at its proximal end into a plurality of flexible latching arms 420 having a ramp portion 480 and ramp face 485, and which may be urged inwardly or interiorly by the neck portion 424 of a release sleeve 440 integral with the proximal shell 402.

However, referring now to FIGS. 4B and 4B-1, rather than employing a resilient biasing element to actuate and effect an emergency or breakaway disconnect, this embodiment employs a second ramp structure 412 disposed on the most proximal portion of the proximal extension 409 of the internal clamping member 408. When sufficient axial force pulls cable 460 and/or internal clamping member 408, second ramps 412 are driven under the ramp portion 480 of each of the latch arms 420, and the ramp portion 480 slides up the second ramp face 430. Lateral translation is permitted to progress until the tips 487 of the latching arms engage the corner 432 of the second ramps 412, at which point the flexible latching arms have been sufficiently depressed to permit a complete disconnection from the receptacle 470.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A quick-disconnect coupling system having a proximal portion and distal portion, said coupling system, comprising:

a proximal shell having a neck portion with a plurality of holes;

a latch arm sleeve slidably inserted into said proximal shell, said latch arm sleeve extending proximally into a plurality of flexible latch arms, each of said latch arms having ramp portions releasably inserted into the holes in said neck portion when said coupling system is not in a disengagement event or not coupled to a receptacle, said latch arm sleeve terminating distally in a distal collar;

a medial coupler slidably inserted into a distal end of said proximal shell, said medial coupler having an internal ring;

a distal clamp member threadably connected to said medial coupler and having clamping means to capture and retain a cable member;

a resilient member disposed between said distal collar and said internal ring and compressible there between; and structure to limit lateral translation of said latch arm sleeve and said latch arms within said proximal shell.

* * * * *